US006636410B2

(12) United States Patent
Ide et al.

(10) Patent No.: US 6,636,410 B2
(45) Date of Patent: Oct. 21, 2003

(54) RELAY APPARATUS

(75) Inventors: Takahiro Ide, Kyoto (JP); Yoshimasa Nagashima, Kyoto (JP)

(73) Assignee: Omron Corporation, Kyoto (JP)

( * ) Notice: Subject to any disclaimer, the term of this patent is extended or adjusted under 35 U.S.C. 154(b) by 29 days.

(21) Appl. No.: 10/000,802

(22) Filed: Dec. 4, 2001

(65) Prior Publication Data

US 2002/0085332 A1 Jul. 4, 2002

(30) Foreign Application Priority Data

Dec. 5, 2000 (JP) ..... 2000-370587

(51) Int. Cl.[7] ..... H01H 47/00
(52) U.S. Cl. ..... 361/152
(58) Field of Search ..... 361/152, 153, 361/154, 160, 170, 187, 189, 190, 194, 195, 196, 197, 198, 205; 251/129.01, 129.02, 129.04, 129.15, 129.2; 166/65.1, 66; 324/654, 655

(56) References Cited

U.S. PATENT DOCUMENTS 3,777,093 A * 12/1973 Sterns et al. ..... 361/207
4,922,363 A * 5/1990 Long et al. ..... 361/146
5,999,395 A 12/1999 Klees ..... 361/166

FOREIGN PATENT DOCUMENTS

| | | |
|---|---|---|
| DE | 197 50 958 A1 | 11/1998 |
| DE | 197 36 183 C1 | 2/1999 |
| DE | 197 51 674 A1 | 4/1999 |
| DE | 199 13 933 A1 | 10/1999 |
| JP | 11-162317 | 6/1999 |

* cited by examiner

*Primary Examiner*—Edward H. Tso
*Assistant Examiner*—Pia Tibbits
(74) *Attorney, Agent, or Firm*—Foley & Lardner

(57) ABSTRACT

Electrical energy is charged to a dielectric by using an energizing unit. A relay apparatus includes a first electromagnetic relay and a second electromagnetic relay. One light-emitting transistor is turned on by self-maintaining the second electromagnetic relay and, then, one light-receiving transistor is turned on. Another light-emitting diode is turned on by discharging the dielectric and another light-receiving transistor is turned on. A power voltage is applied to a base of a transistor for start, and the transistor for start is turned on. The first electromagnetic relay is self-maintained, an interval between output terminals is energized, and a load is driven. Accordingly, the relay apparatus can be miniaturized with a safety function and with low costs.

11 Claims, 6 Drawing Sheets

RELAY APPARATUS

CROSS-REFERENCES TO RELATED APPLICATION

This application claims all benefits accruing under Paris Convention from the Japanese Patent Application No. 2000-370587, filed on Dec. 5, 2000.

BACKGROUND OF THE INVENTION

1. Field of the Invention

The present invention relates to a relay apparatus, with reliability, which is suitable for, e.g., an application in which load as a target is driven only upon completely satisfying a plurality of input conditions for safety confirmation, etc. More particularly, the present invention relates to a relay apparatus, with a safety function by which the relay apparatus is completely operated even in a failure mode of the welding and fixing of a relay contact and an external input contact, and the failure mode is detected and is prevented at the next driving operation of the relay apparatus.

2. Description of the Related Art

The above-mentioned relay apparatus with the safety function shown in a circuit diagram in FIG. 6 is well-known. As shown in FIG. 6, the relay apparatus with the safety function comprises: two input terminals T11 and T12 and two input terminals T21 and T22, to which external non-voltage contacts are connected; two input corresponding electromagnetic relays provided corresponding to the number of the input terminals (hereinafter, one input corresponding electromagnetic relay is referred to as a first electromagnetic relay, and the other input corresponding electromagnetic relay is referred to as a second electromagnetic relay); a self-maintaining set relay for outputting a self-maintenance setting signal to the first and second electromagnetic relays; and output terminals OUT1 and OUT2 to be connected to loads.

A first switch S1 and a second switch S2 connected to the input terminals T11 and T12 and the input terminals T21 and T22 comprise contacts such as limit switches comprising external non-voltage contacts. A coil K1 of the first electromagnetic relay functions as an input corresponding electromagnetic relay, a coil K2 of the second electromagnetic relay functions as an input corresponding electromagnetic relay, and a coil K3 of a third electromagnetic relay functions as a self-maintaining relay.

The coil K1, a constant-opened contact K1-2 for output, a constant-opened contact K1-1 for control, and a constant-closed contact K1-3 for control are provided for the first electromagnetic relay which functions as the input corresponding electromagnetic relay. Also, the coil K2, a constant-opened contact K2-2 for output, a constant-opened contact K2-1 for control, and a constant-closed contact K2-3 for control are provided for the second electromagnetic relay which functions as the input corresponding electromagnetic relay. Further, constant-opened contacts K3-1 and K3-2 for outputting a self-maintenance setting signal to the first electromagnetic relay and the second electromagnetic relay and a constant-closed contact K3-3 for output are provided for the third electromagnetic relay which functions as the self-maintaining relay.

The first switch S1 connected to the input terminals T11 and T12, as the external non-voltage contact, the constant-opened contact K1-1 for control of the first electromagnetic relay, as the input corresponding electromagnetic relay assigned to the first switch S1, and the coil K1 of the first electromagnetic relay are serially connected among terminals of a power source E. As a consequence, a self-maintaining circuit of the first electromagnetic relay is formed in which the first switch S1 is a contact for reset and the constant-opened contact K1-1 for control is a contact for maintenance.

Also, the second switch S2 connected to the input terminals T21 and T22, as the external non-voltage contact, the constant-opened contact K2-1 for control of the second electromagnetic relay, as the input corresponding electromagnetic relay assigned to the second switch S2, and the coil K2 of the second electromagnetic relay are serially connected among terminals of the power source E. As a consequence, a self-maintaining circuit of the second electromagnetic relay is formed in which the second switch S2 is a contact for reset and the constant-opened contact K2-1 for control is a contact for maintenance.

The constant-closed contacts K1-3 and K2-3 for control of the first and second electromagnetic relays as the input corresponding electromagnetic relays are serially connected and are inserted to a closed circuit via the power source E. The coil (input circuit) K3 of the third electromagnetic relay comprising the self-maintaining relay is further inserted to the closed circuit. The above-mentioned switch for set in the self-maintenance comprises the constant-opened contacts (output circuits) K3-1 and K3-2 for control of the third electromagnetic relay comprising the self-maintaining relay.

Further, the constant-opened contacts K1-2 and K2-2 of the first and second electromagnetic relays as the input corresponding electromagnetic relays and the constant-closed contacts K3-3 for output of the third electromagnetic relay as the self-maintaining relay are serially connected between the output terminals OUT1 and OUT2. As a consequence, a closed circuit via a load (not shown) is constituted.

Next, an operation will be described. When all of the first electromagnetic relay, the second electromagnetic relay, and the third electromagnetic relay are normal, only if both the first switch S1 and the second switch S2 are closed, an interval between the output terminal OUT1 and the output terminal OUT2 is opened. In other words, if one of the first switch S1 and the second switch S2 is opened, the interval between the output terminal OUT1 and the output terminal OUT2 is opened.

If a failure of contact welding (fixing) is caused in any of the first electromagnetic relay, the second electromagnetic relay, and the third electromagnetic relay, even if the failed electromagnetic relay is operated, one of the first switch S1 and the second switch S2 is opened. The interval between the output terminal OUT1 and the output terminal OUT2 is normally opened. Further, when a failure of devices is caused in the relay apparatus with the safety function, even if both the first switch S1 and the second switch S2 are thereafter closed, the interval between the output terminal OUT1 and the output terminal OUT2 is not closed. That is, if a failure is caused at the coil or the contact of the incorporated relay, the safety function is automatically operated.

However, the conventional relay apparatus needs a single electromagnetic relay as a self-maintaining relay as well as the two electromagnetic relays as the input corresponding electromagnetic relays and, therefore, there is a problem in that the overall apparatus is necessarily increased in scale.

SUMMARY OF THE INVENTION

The present invention is devised in the consideration of the above-mentioned problem and it is an object of the present invention to provide a relay apparatus, with a safety function, which is miniaturized.

To accomplish the above-mentioned object, according to the present invention, there is provided a relay apparatus comprising: at least one self-maintaining relay and another self-maintaining relay which are provided corresponding to input terminals; a dielectric which charges and discharges electrical energy; energizing means which energizes the dielectric and charges the electrical energy to the dielectric; one starting means which outputs a start signal to an input side of the one self-maintaining relay and enables a self-maintaining circuit of the one self-maintaining relay to be formed; another starting means which is operated by a self-maintaining operation of the one self-maintaining relay, outputs the electrical energy charged to the dielectric as a start signal, and enables a self-maintaining circuit of the other self-maintaining relay to be formed; and output means which is operated by the self-maintaining operations of the one self-maintaining relay and the other self-maintaining relay and outputs an output signal to an output terminal connected to a load, and wherein the one self-maintaining relay and the other self-maintaining relay comprise an electromagnetic relay and the other starting means comprises an electronic circuit including the dielectric.

With the above-mentioned structure, the energizing means charges the electrical energy to the dielectric. The one starting means outputs the start signal to the input side of the one self-maintaining relay and enables the self-maintaining circuit of the one self-maintaining relay to be formed. The other starting means is operated by the self-maintaining operation of the one self-maintaining relay, outputs the electrical energy charged to the dielectric as the start signal, and enables the self-maintaining circuit of the other self-maintaining relay to be formed. An interval between output terminals in the output means is energized and the load connected to the energized interval can be driven.

In this case, the one self-maintaining relay and the other self-maintaining relay comprise the electromagnetic relay, and the other starting means comprises the electronic circuit including the dielectric. The relay apparatus can be miniaturized with the safety function and with low costs.

If a failure due to short-circuit is caused in the one starting means, the energizing means charges the electrical energy to the dielectric. However, since the one starting means is failed due to the short-circuit, the self-maintaining circuit of the one self-maintaining relay is formed and the dielectric cannot sufficiently be charged.

By self-maintaining the one self-maintaining relay, the other starting means is operated. However, since the dielectric cannot sufficiently be charged, the self-maintaining circuit of the other self-maintaining relay is not formed. The interval between the output terminals in the output means is not energized and the load cannot be driven.

As mentioned above, by driving no load, not only the safety function can further be improved but also the occurrence of the failure due to the short-circuit can easily and fast be detected.

In the relay apparatus according to the present invention, the one self-maintaining relay and the other self-maintaining relay comprise an electromagnetic relay with a forced guiding mechanism, and the other starting means comprises: the dielectric which charges the electrical energy by energization and discharges the electrical energy when the other self-maintaining relay is self-maintained; switching means for start, which outputs a start signal to the other self-maintaining relay; first switching means which is operated when the one self-maintaining relay is self-maintained and outputs the electrical energy charged to the dielectric, as the start signal; and second switching means which is operated by receiving the output signal from the first switching means and conducts a power voltage to the switching means for start so as to operate the switching means for start.

The switching means for start is a transistor for start. The first switching means comprises a first photo coupler. The first photo coupler comprises a light-emitting diode which emits light as an output when the one self-maintaining relay is self-maintained and a light-receiving transistor which is operated by the output of the light-emitting diode and outputs the electrical energy charged to the dielectric as the start signal, and the second switching means comprises a second photo coupler, the second photo coupler comprises a light-emitting diode which emits light as an output by receiving the output signal of the light-receiving transistor in the first photo coupler and a light-receiving transistor which is operated by the output of the light-emitting diode and conducts the power voltage to the transistor for start so as to operate the transistor for start.

Therefore, the energizing means charges the electrical energy to the dielectric, the first switching means is operated when the one self-maintaining relay is self-maintained, and the electrical energy charged to the dielectric is outputted, as the start signal. The second switching means is operated by the start signal and the power voltage is conducted to the switching means for start (transistor for start) so as to operate the switching means for start (transistor for start). The other self-maintaining relay is self-maintained, thus, the interval between the output terminals is energized, and the load connected to the energized interval can be driven.

In this case, the one self-maintaining relay and the other self-maintaining relay comprise the electromagnetic relay with the safety function, and the other starting means comprises the electronic circuit. Therefore, the relay apparatus can be miniaturized with the safety function and with low costs.

If a failure due to short-circuit is caused in the one starting means, the other starting means is operated by self-maintaining the one self-maintaining relay. However, since the electrical energy cannot sufficiently be charged to the dielectric, the self-maintaining circuit of the other self-maintaining relay is not formed. The interval between the output terminals in the output means is not energized and the load is not driven. By driving no load, not only the safety function can further be improved but also the occurrence of failure due to the short-circuit can easily and fast be detected.

In the relay apparatus according to the present invention, the one self-maintaining relay and the other self-maintaining relay comprise an electromagnetic relay with a forced guiding mechanism, the other starting means comprises: the dielectric which charges the electrical energy by energization and discharges the electrical energy when the other self-maintaining relay is self-maintained; third switching means which is operated when the one self-maintaining relay is self-maintained and outputs the electrical energy charged to the dielectric, as the start signal; and fourth switching means which is operated by receiving the start signal from the third switching means and conducts a power voltage to an input side of the other self-maintaining relay so as to self-maintain the other self-maintaining relay.

The third switching means comprises a third photo coupler, the third photo coupler comprises a light-emitting diode which emits light as an output when the one self-maintaining relay is self-maintained and a light-receiving transistor which outputs the electrical energy charged to the dielectric as the start signal, and the fourth switching means comprises a fourth photo coupler, the fourth photo coupler comprises a light-emitting diode which emits light as an output by receiving the output signal of the light-receiving transistor in the third photo coupler and a light-receiving transistor which is operated by the output of the light-emitting diode and conducts the power voltage to an input side of the other self-maintaining relay so as to self-maintain the other self-maintaining relay.

Therefore, the energizing means charges the electrical energy to the dielectric, the third switching means is operated when the one self-maintaining relay is self-maintained, and the electrical energy charged to the dielectric is outputted, as the start signal. The fourth switching means is operated by the start signal and a power voltage is conducted to the input side of the other self-maintaining relay so as to self-maintain the other self-maintaining relay. Thus, the interval between the output terminals is energized and the load connected to the energized interval can be driven.

In this case, the one self-maintaining relay and the other self-maintaining relay comprise the electromagnetic relay with a forced guiding mechanism, and the other starting means comprises the electronic circuit. Accordingly, the relay apparatus can be miniaturized with the safety function and with low costs.

If a failure due to short-circuit is caused in the one starting means, the other starting means is operated by self-maintaining the one self-maintaining relay. However, since the electrical energy cannot sufficiently be charged to the dielectric, the self-maintaining circuit of the other self-maintaining relay is not formed. The interval between the output terminals is not energized and the load is not driven. By driving no load, not only the safety function can further be improved but also the occurrence of failure due to the short-circuit can easily and fast be detected.

In the relay apparatus according to the present invention, the one self-maintaining relay and the other self-maintaining relay comprise an electromagnetic relay with a forced guiding mechanism, and the other starting means comprises: the dielectric which charges the electrical energy by energization and discharges the electrical energy when the one self-maintaining relay is self-maintained; switching means for start, which outputs the start signal to the other self-maintaining relay; and fifth switching means which is operated when the one self-maintaining relay is self-maintained and conducts the electrical energy charged to the dielectric to the switching means for start so as to operate the switching means for start.

The switching means for start is a transistor for start. The fifth switching means comprises a fifth photo coupler. The fifth photo coupler comprises a light-emitting diode which emits light as an output when the one self-maintaining relay is self-maintained and a light-receiving transistor which is operated by the output of the light-emitting diode and conducts the electrical energy charged to the dielectric, as the start signal, so as to operate the transistor for start.

Therefore, the energizing means charges the electrical energy to the dielectric. The fifth switching means is operated when the one self-maintaining relay is self-maintained, and conducts the electrical energy charged to the dielectric to the switching means for start so as to operate the switching means for start (transistor for start). The self-maintaining relay is self-maintained. Thus, the interval between the output terminals is energized and the load connected to the energized interval can be driven.

In this case, the one self-maintaining relay and the other self-maintaining relay comprise the electromagnetic relay with a forced guiding mechanism, and the other starting means comprises the electronic circuit. Accordingly, the relay apparatus can be miniaturized with the safety function and with low costs.

If a failure due to short-circuit is caused in the one starting means, the other starting means is operated by self-maintaining the one self-maintaining relay. However, since the electrical energy cannot sufficiently be charged to the dielectric, the self-maintaining circuit of the other self-maintaining relay is not formed. The interval between the output terminals in the output means is not energized and the load is not driven. By driving no load, not only the safety function can further be improved but also the occurrence of failure due to the short-circuit can easily and fast be detected.

In the relay apparatus according to the present invention, the energizing means is an external input contact portion which outputs a self-maintenance setting signal to the one self-maintaining relay, the one starting means is an external input contact portion for start, which outputs a self-maintenance setting signal to the one self-maintaining relay.

The relay apparatus according to the present invention further comprises: threshold setting means which sets a threshold of a drive voltage for driving the transistor for start.

The relay apparatus according to the present invention further comprises: threshold setting means which sets a threshold of a drive voltage for driving the light-receiving transistor in the fourth photo coupler.

The threshold setting means comprises: the dielectric which varies a charge voltage by changing a capacitance; a resistor which limits charges in the dielectric; and a Zener diode for setting a threshold, which outputs the drive voltage when the charge voltage of the dielectric is higher than a set voltage.

With the above-mentioned structure, the threshold can be determined depending on the selection of the resistor, the Zener diode for setting the threshold, and the dielectric. Further, since the failure due to the short-circuit in the external input for start can be solved in response to the user's request, a relay apparatus having two systems can be realized on a single substrate without changing the circuit structure.

Incidentally, in the "electromagnetic relay with the forced guiding mechanism" including one electromagnetic relay and another electromagnetic relay, when a constant-opened contact of the one electromagnetic relay is welded (fixed), a constant-closed contact of the other electromagnetic relay is opened while the coil is not excited and, further, when a constant-closed contact of the one electromagnetic relay is welded (fixed), a constant-opened contact of the other electromagnetic relay is opened while the coil is excited.

DESCRIPTION OF THE PREFERRED EMBODIMENTS

Hereinbelow, a relay apparatus in the present invention will be described in detail with reference to the drawings.

First embodiment

Figure 1:
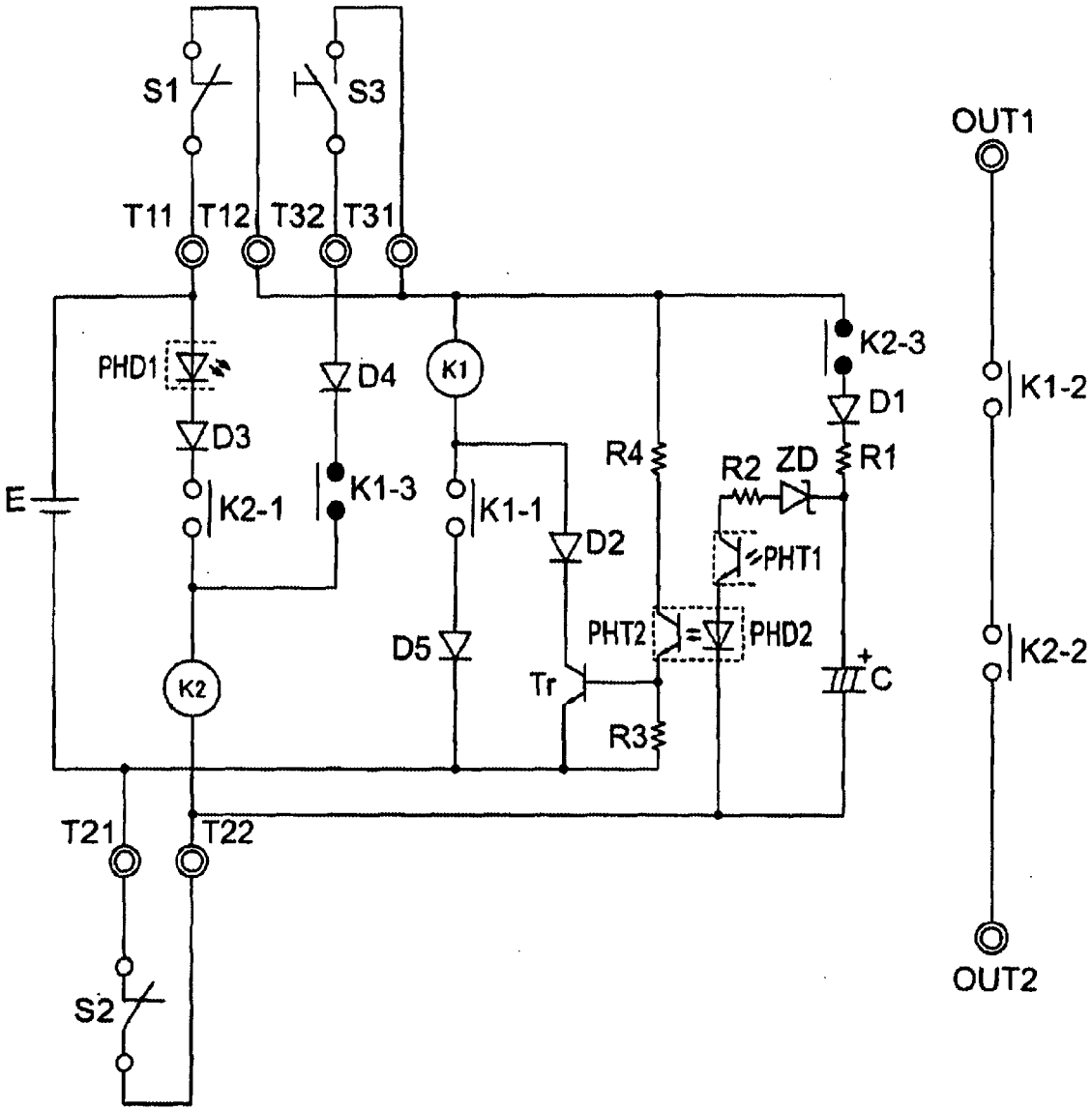
FIG. 1 is a circuit diagram showing the structure of a relay apparatus according to a first embodiment of the present invention.

FIG. 1 shows the structure of a relay apparatus according to a first embodiment of the present invention. Referring to FIG. 1, the relay apparatus with a safety function comprises: two input terminals T11 and T12 and two input terminals T21 and T22, to which external input contact portions (external contacts) are connected; first and second input corresponding electromagnetic relays provided corresponding to the input terminals T11, T12, T21, and T22 (hereinafter, the first and second input corresponding electromagnetic relays are referred to as a first electromagnetic relay, serving as a self-maintaining relay of the second electromagnetic relay, and as a second electromagnetic relay, serving as a self-maintaining relay of the first electromagnetic relay); a capacitor (dielectric) C for charging and discharging electrical energy; energizing means for charging the electrical energy to the capacitor (dielectric) C by energization; one starting means for outputting a start signal to an input of the second electromagnetic relay as the self-maintaining relay of the first electromagnetic relay and forming a self-maintaining circuit of the second electromagnetic relay; another starting means for being operated by a self-maintaining operation of the second electromagnetic relay, outputting a start signal to an input of the first electromagnetic relay, and forming a self-maintaining circuit of the first electromagnetic relay; and output means for being operated by a self-maintaining operation of the first and second electromagnetic relays and outputting an output signal to the output terminals OUT1 and OUT2 connected to a load (not shown).

The first electromagnetic relay comprising the self-maintaining relay of the second electromagnetic relay and the second electromagnetic relay comprising the self-maintaining relay of the first electromagnetic relay comprise electromagnetic relays with forced guiding mechanisms. In the electromagnetic relay with the forced guiding mechanism, when a constant-opened contact of the first electromagnetic relay is welded (fixed), a constant-closed contact of the second electromagnetic relay is opened while the coil is not excited and, when a constant-closed contact of the first electromagnetic relay is welded (fixed), a constant-opened contact of the second electromagnetic relay is opened while the coil is excited.

The first electromagnetic relay comprises the coil K1, the constant-opened contact K1-2 for output, the constant-opened contact K1-1 for control, and the constant-closed contact K1-3 for control. Also, the second electromagnetic relay comprises the coil K2, the constant-opened contact K2-2 for output, the constant-opened contact K2-1 for control, and the constant-closed contact K2-3 for control.

The other starting means comprises an electronic circuit as self-maintenance setting signal output means for outputting a self-maintenance setting signal to the first electromagnetic relay. That is, the other starting means comprises: a capacitor (dielectric) C for charging electrical energy by energization and discharging the electrical energy when the second electromagnetic relay as the self-maintaining relay of the first electromagnetic relay is self-maintained; a transistor Tr for start, as switching means for start which outputs a start signal to the first electromagnetic relay as the self-maintaining relay of the second electromagnetic relay; first switching means which is operated when the second electromagnetic relay is self-maintained and outputs the electrical energy charged to the capacitor (dielectric) C as a start signal; and second switching means which is operated by receiving the output signal from the first switching means and conducts a power voltage to the transistor Tr for start so as to operate the transistor Tr for start.

The first switching means comprises a first photo coupler (phototransistor). The first photo coupler comprises a light-emitting diode PHD1 which emits light as an output when the second electromagnetic relay is self-maintained and a light-receiving transistor PHT1 which is operated by the output of the light-emitting diode PHD1 and outputs the electrical energy charged to the capacitor (dielectric) C as a start signal.

The second switching means comprises a second photo coupler (phototransistor). The second photo coupler comprises a light-emitting diode PHD2 which emits light as an output by receiving the output signal of the light-receiving transistor PHT1 in the first photo coupler and a light-receiving transistor PHT2 which is operated by the output signal of the light-emitting diode PHD2 and conducts a power voltage to the transistor Tr for start so as to operate the transistor Tr for start.

The self-maintenance setting signal output means for outputting the self-maintenance setting signal to the second electromagnetic relay comprises a third switch (reset switch) S3, as an external input for start (external input contact portion) connected to input terminals 31 and 32.

The first switch S1, as an external input 1, is connected to the input terminals T11 and T12. The first switch S1 is a contact of a limit switch comprising an external input contact portion (external non-voltage contact) or the like. The second switch S2, as an external input contact 2, is connected to the input terminals T21 and T22. The second switch S2 is a contact of a limit switch comprising an external input contact portion (external non-voltage contact) or the like.

The first switch S1, the coil K1 of the first electromagnetic relay, allocated to the input terminals T11 and T12, the constant-opened contact K1-1 for control, and a diode D5 are serially connected among terminals of the power source E. As a consequence, a self-maintaining circuit of the first electromagnetic relay is formed in which the first switch S1 is a contact for reset and the constant-opened contact K1-1 for control is a contact for maintenance.

The transistor Tr for start is integrated in the self-maintaining circuit of the first electromagnetic relay, in parallel with the constant-opened contact K1 for control and the diode D5. The diode D2 is integrated in a collector of the transistor Tr for start.

The second switch S2 is serially connected to the diode D3, the constant-opened contact K2-1 for control of the second electromagnetic relay allocated to the input terminals T21 and T22 and the coil K2 of the second electromagnetic relay, among the terminals of the power source E. As a consequence, a self-maintaining circuit of the second electromagnetic relay is formed in which the second switch S2 is a contact for reset and the constant-opened contact K2-1 for control is a contact for maintenance.

The light-emitting diode PHD1 of the first photo coupler is integrated, at an anode of the diode D3, in the self-maintaining circuit of the second electromagnetic relay.

The third switch S3 is connected to the positive of the coil K2 of the second electromagnetic relay via a diode D4 and the constant-closed contact K1-3 for control of the first electromagnetic relay.

Accordingly, energizing means of the capacitor (charger) C comprises the first and second switches S1 and S2. The one starting means for starting the self-maintaining circuit of the second electromagnetic relay comprises the third switch S3.

The first switch S1, the constant-closed contact K2-3 for control of the second electromagnetic relay, the diode D1, the resistor R1, the capacitor (charger) C, and the second switch S2 are serially connected in order thereof and are inserted in a closed circuit via the power source E. The first switch S1, the constant-closed contact K2-3 for control of the second electromagnetic relay, the diode D1, the resistor R1, a Zener diode ZD for setting a threshold, a resistor R2, the light-receiving transistor PHT1 of the first photo coupler, and the light-emitting diode PHD2 of the second photo coupler are serially connected in order thereof and are inserted in a closed circuit via the power source E.

The first switch S1, a resistor R4, the light-receiving transistor PHT2 of the second photo coupler, and a resistor R3 are serially connected in order thereof and are inserted in a closed circuit via the power source E. An emitter (output side) of the light-receiving transistor PHT2 is connected to a base of the transistor Tr for start.

The capacitor (charger) C is a capacitor for adjusting a threshold which can change a charge voltage represented by (charge/discharge curve in FIG. 2) by varying a capacitance, the resistor R1 is a resistor which limits charges in the capacitor (capacitor) C, the resistor R2 is a resistor which adjusts a current value of a discharge current from the capacitor (charger) C, the resistor R3 is a resistor between the base and the emitter of the transistor Tr for start, and the resistor R4 is a resistor which adjusts current which flows to the base of the transistor Tr for start. When the charge voltage of the capacitor (charger) C is over a set voltage, the Zener diode ZD for setting the threshold operates so that current flows to the resistor R2, the light-emitting transistor PHT1 of the first photo coupler, and the light-emitting diode PHD2 of the second photo coupler.

Hence, threshold setting means, which sets the threshold of a drive voltage for driving the transistor Tr for start, comprises the capacitor (dielectric) C, the Zener diode ZD for setting the threshold, and the resistor R2.

Further, the constant-opened contacts K1-2 and K2-2 for output of the first and second electromagnetic relays are serially connected and are inserted between the output terminals OUT1 and OUT2. Thus, output means comprises the closed circuit, not-via a load (not shown).

Figure 3:
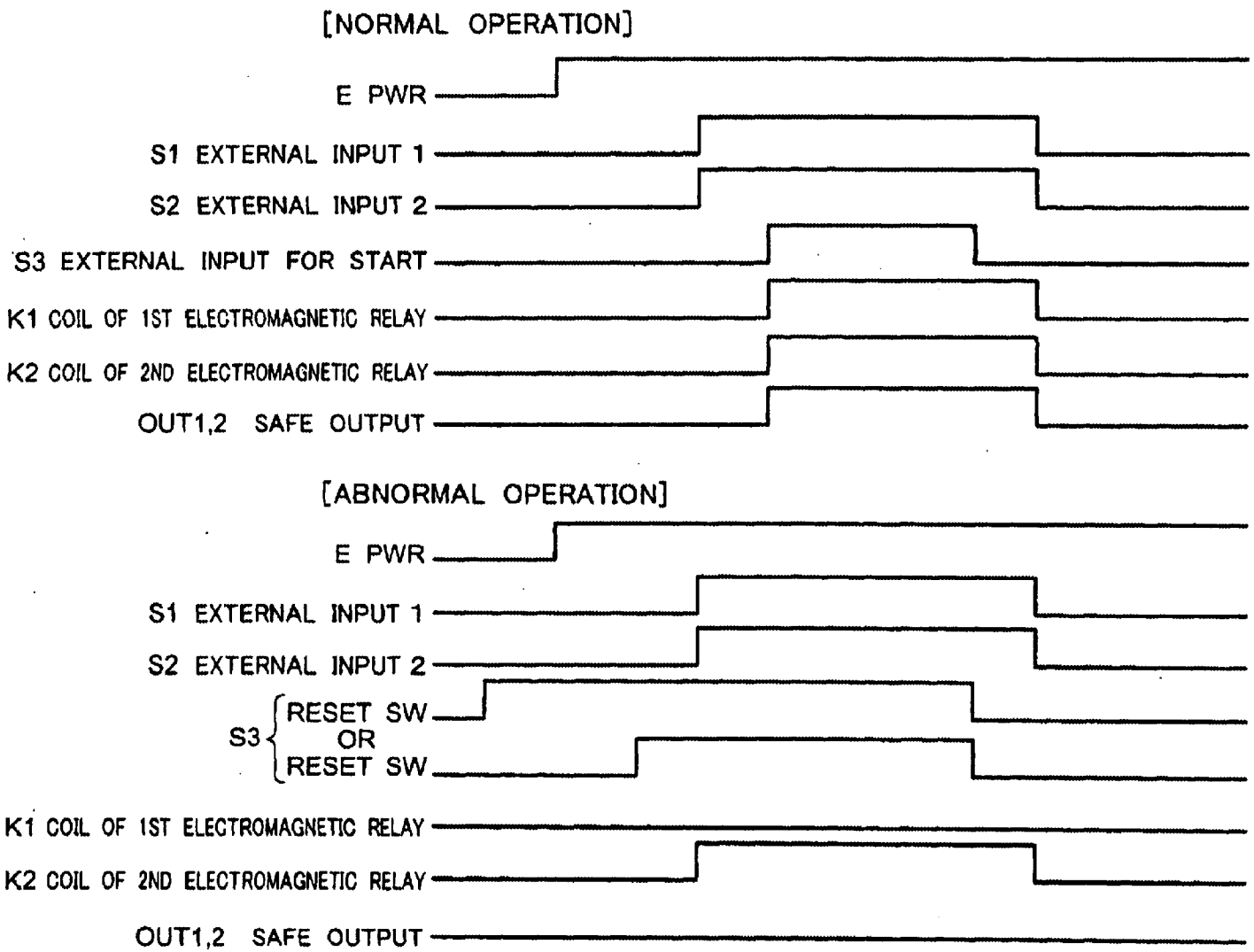
FIG. 3 is a time chart for the relay apparatus.

Next, a description is given of operations of the relay apparatus having the above-mentioned structure with reference to a time chart of FIG. 3.

(Normal Operation)

Figure 2:
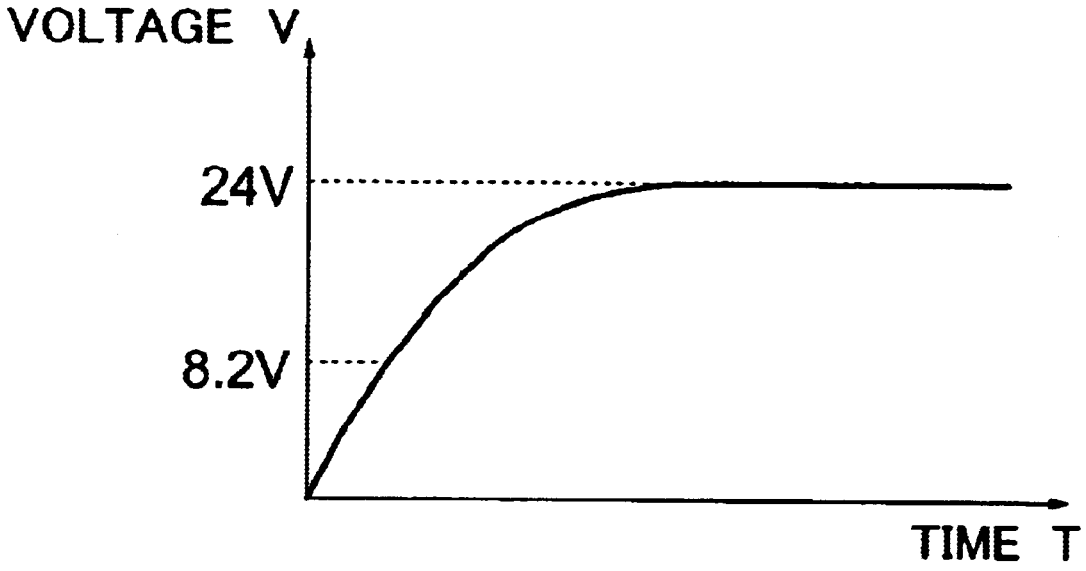
FIG. 2 is a diagram showing a charge/discharge curve of a capacitor (dielectric) in the relay apparatus according to the first embodiment.

When the first switch S1 as the external input 1 and the second switch S2 as the external input 2 are closed, the capacitor (charger) C is charged. Further, the capacitor (charger) C and the resistor R1 cause a charge/discharge curve as shown in FIG. 2, and a potential at the cathode of the Zener diode ZD for setting threshold is 24 VDC.

When the third switch (reset switch) S3 as the external input terminal for start is manually set, the coil K2 of the second electromagnetic relay is excited. Thus, the constant-opened contact K2-2 for output is closed, the constant-opened contact K2-1 for control is closed, and the constant-closed contact K2-3 for control is opened.

The constant-opened contact K2-1 for control for self-maintenance is closed, thereby, current flows to the light-emitting diode PHD1 of the first photo coupler, which is serially connected to the constant-opened contact K2-1 for control, and the light-receiving transistor PHT1, which is optically coupled to the light-receiving diode PHD1, is turned on.

By turning on the light-receiving transistor PHT1, current, which is generated by the discharge of the capacitor (charger) C, flows to the light-emitting diode PHD2 of the second photo coupler. Then, the light-receiving transistor PHT2, which is optically coupled to the light-emitting diode PHD2, is turned on.

A voltage, which is led at the resistor R4 from the power source E, is applied to the base of the transistor Tr for start by turning on the light-receiving transistor PHT2, the transistor Tr for start is turned on, the coil K1 of the first electromagnetic relay is excited, and the constant-opened contact K1-2 for output is closed. Then, the constant-opened contact K1-1 for control is closed and the constant-closed contact K1-3 for control is opened.

Incidentally, a threshold for operating the transistor Tr for start is set to be, e.g., 8.2 V. The threshold is determined by a current value based on the discharge of the capacitor (charger) C, which causes the light emission of the light-emitting diode PHD2 of the photo coupler. Further, the threshold is determined depending on the selection of the resistor R1, the Zener diode ZD for setting the threshold, and the capacitor (charger) C.

As mentioned above, the transistor Tr for start outputs a self-maintenance setting signal to the coil K1 of the first electromagnetic relay. Thus, the first electromagnetic relay is self-maintained and the constant-opened contact K1-2 for output is closed. Then, the interval between the output terminals OUT1 and OUT2 are energized and a load connected to the energized interval is driven.

On the contrary, if any of the first switch S1 and the second switch S2 is opened, the self-maintaining state of the first electromagnetic relay or the second electromagnetic relay is canceled. The constant-opened contact K1-2 or K2-2 for output is opened, thereby stopping the driving operation of the load.

(Abnormal Operation)

Next a description is given of operations of the relay apparatus when a failure due to short-circuit is caused in the third switch S3 as the external input contact portion.

When the first switch S1 and the second switch S2 are closed in a state in which the failure due to the short-circuit is caused in the third switch S3, the capacitor (charger) C is to be charged via the resistor R1. However, the third switch S3 is failed due to the short-circuit and, therefore, a voltage is applied to the positive side of the coil K2 of the second electromagnetic relay. Then, the coil K2 is excited and the constant-closed contact K2-3 for control is opened. Thus, the capacitor (charger) C cannot sufficiently be charged.

The excitation of the coil K2 of the second electromagnetic relay causes the constant-opened contact K2-1 for control for self maintenance to be closed, and current flows to the light-emitting diode PHD1 of the photo coupler. Then, the light-receiving transistor PHT1, which is optically coupled to the light-receiving diode PHD1, is turned on. However, the capacitor (charger) C cannot sufficiently be charged, that is, the amount of charges to generate a voltage of 8.2 V or more is not charged and, therefore, the light-emitting diode PHD2 of the second photo coupler cannot emit light. Also, the transistor Tr for start cannot be turned on.

Therefore, the transistor Tr for start cannot output the self-maintenance setting signal to the coil K1 of the first electromagnetic relay, and the first electromagnetic relay is not self-maintained. The constant-opened contact K1-2 for output is not closed, the interval between the output terminals OUT1 and OUT2 is not energized, and the load connected to the energized interval is not driven.

If the sequence of the external inputs 1 and 2 through the two external input contact portions and the external input for start through the external input contact portion for start is reversed, a signal is not safely outputted. Therefore, the check for the sequence of the external input can be executed.

According to the first embodiment of the present invention, the first and second electromagnetic relays comprise an electromagnetic relay with a forced guiding mechanism and the self-maintenance setting signal output means (the other starting means) for outputting the self-maintenance setting signal to the first electromagnetic relay is formed of an electronic circuit. The relay apparatus can be miniaturized with the safety function and with low costs.

The load is driven when the failure due to the short-circuit is caused in the third switch S3 as the external input contact portion for start of the one starting means. Therefore, the safety function can further be improved and the occurrence of the failure due to the short-circuit can be easily and fast detected.

Second Embodiment

Figure 4:
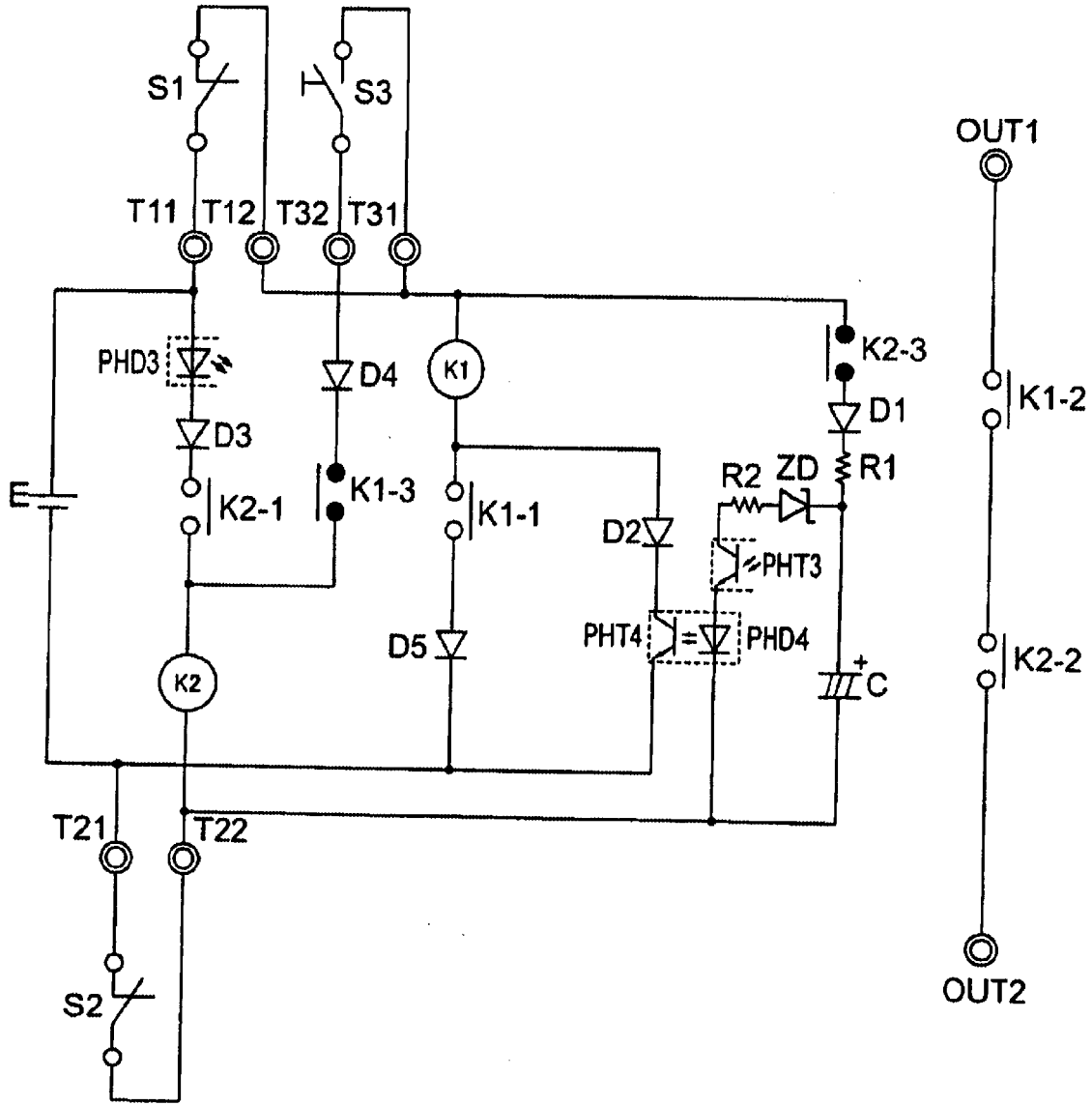
FIG. 4 is a circuit diagram showing the structure of a relay apparatus according to a second embodiment of the present invention.
Figure 5:
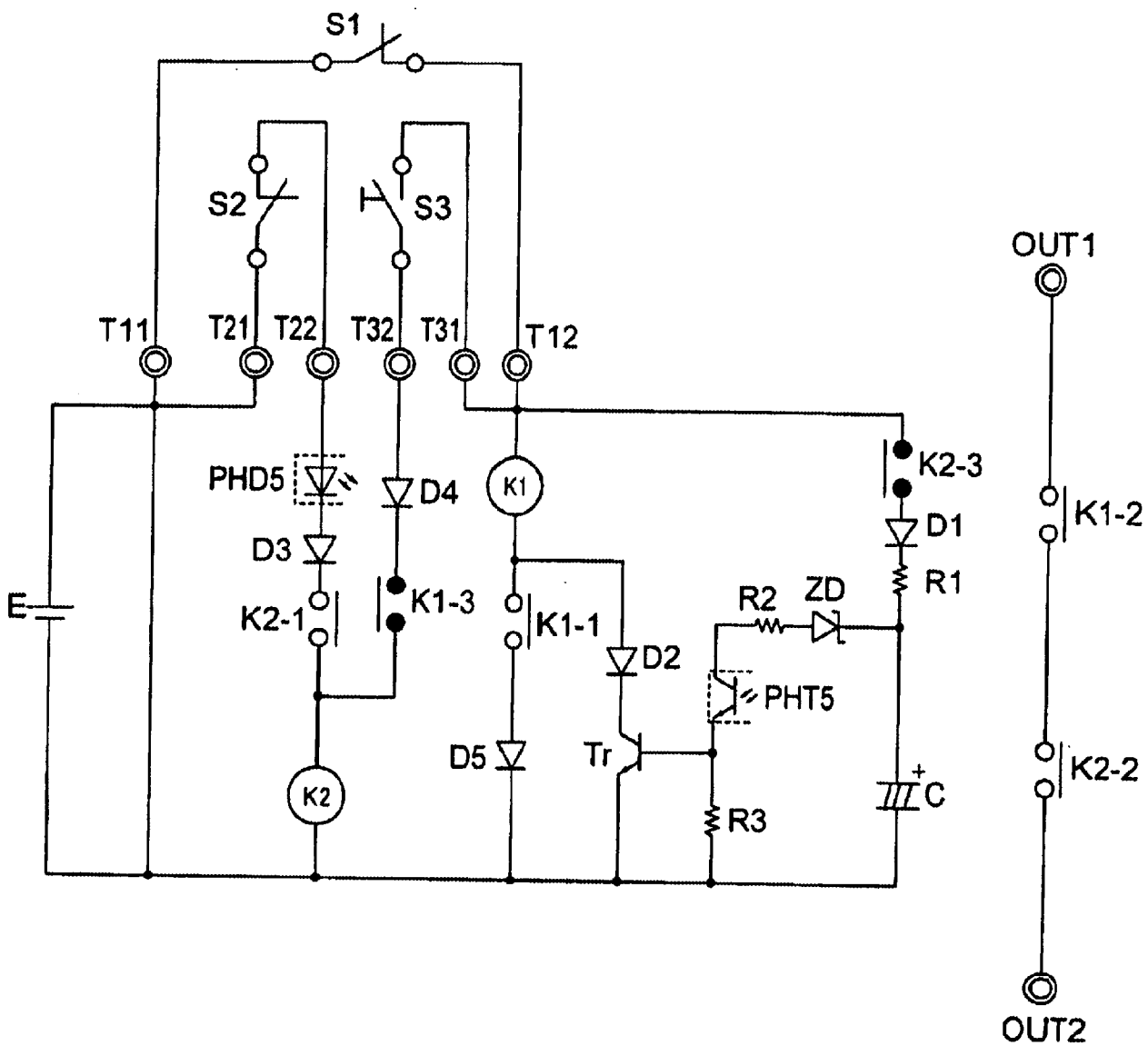
FIG. 5 is a circuit diagram showing the structure of a relay apparatus according to a third embodiment of the present invention.
Figure 6:
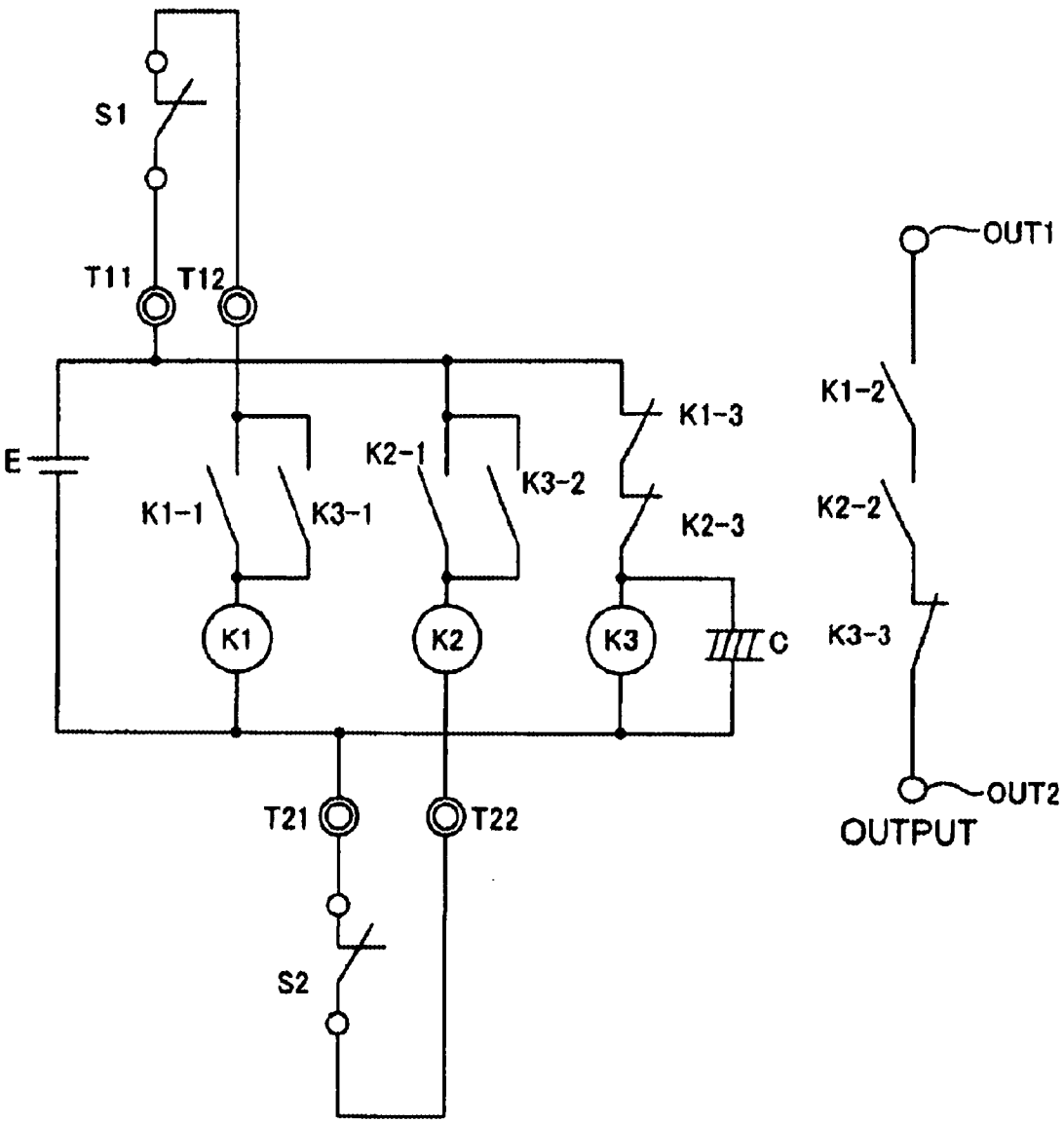
FIG.6 (Prior Art)
FIG. 6 is a circuit diagram showing the structure of a conventional relay apparatus.

FIG. 4 shows the structure of a relay apparatus according to a second embodiment of the present invention.

According to the first embodiment, the coil K1 of the first electromagnetic relay is excited by turning on the transistor Tr for start. Because a current amplification factor of the second photo coupler (the light-emitting diode PHD2 and the light-receiving transistor PHT2) is low. If a photo coupler having a high current amplification factor is used, the transistor Tr for start is not necessary.

According to the second embodiment of the present invention, the relay apparatus uses the photo coupler having the high current amplification factor.

Hence, according to the second embodiment of the present invention, in the relay apparatus, the other starting means comprises: a capacitor (dielectric) C which charges electrical energy by energization and discharges the electrical energy when the second electromagnetic relay as the self-maintaining relay of the first electromagnetic relay is self-maintained; the third switching means which is operated when the second electromagnetic relay is self-maintained and outputs the electrical energy charged in the capacitor (dielectric) C as a start signal; and fourth switching means which is operated by the reception of the start signal from the third switching means and conducts a power voltage to the input side of the first electromagnetic relay as the self-maintaining relay of the second electromagnetic relay so as to self-maintain the first electromagnetic relay.

The third switching means comprises a third photo coupler (phototransistor), and the fourth switching means comprises a fourth photo coupler (phototransistor coupler).

In other words, the first switch S1, the coil K1 of the first electromagnetic relay allocated to the input terminals T11 and T12, the constant-opened contact K1-1 for control, and the diode D5 are serially connected among the terminals of the power source E. Thus, a self-maintaining circuit of the first electromagnetic relay is formed in which the first switch S1 is a constant for reset and the constant-opened contact K1-1 for control is a contact for maintenance. A light-emitting diode PHD3 of the third coupler is integrated in the self-maintaining circuit, in parallel with the constant-opened contact K1-1 for control and the diode D5. The diode D2 is integrated to the collector of the light-emitting diode PHD3.

The first switch S1, the constant-closed contact K2-3 for control of the second electromagnetic relay, the diode D1, the resistor R1, the capacitor (charger) C, and the second switch S2 are serially connected in order thereof and are inserted to a closed circuit via the power source E. The first switch S1, the constant-closed contact K2-3 for control of the second electromagnetic relay, the diode D1, the resistor R1, the Zener diode ZD for setting the threshold, the resistor R2, the light-receiving transistor PHT3 of the third photo coupler, the light-emitting diode PHD4 of the fourth photo coupler, and the second switch S2 are serially connected in order thereof and are inserted to a closed circuit via the power source E.

Therefore, threshold setting means for setting a threshold of a drive voltage for driving the light-emitting diode PHD4 of the fourth photo coupler comprises the capacitor (dielectric) C, the Zener diode ZD for setting the threshold, and the resistor R2.

According to the second embodiment of the present invention, other structures are similar to those of the relay apparatus according to the first embodiment of the present invention, and the description of the other structures is omitted.

Next, a description is given of operations of the relay apparatus having the above structures.

(Normal Operation)

When the first switch S1 as the external input 1 and the second switch S2 as the external input 2 are closed, the capacitor (charger) C is charged. A potential of a cathode of the Zener diode ZD for setting the threshold is, e.g., 24 VDC by the capacitor (charger) C and the resistor R1.

When the third switch (reset switch) S3 as an external input for start is manually set, the coil K2 of the second electromagnetic relay is excited and the constant-opened contact K2-2 for output is closed. Then, the constant-opened contact K2-1 for control is closed and the constant-closed contact K2-3 for control is opened.

By closing the constant-opened contact K2-1 for control for self-maintenance, current flows to the light-emitting diode PHD3 of the third photo coupler, which is serially connected to the constant-opened contact K2-1 for control. Then, the light-receiving transistor PHT3, which is optically coupled to the light-emitting diode PHD3, is turned on.

By turning on the light-receiving transistor PHT3, current, which is generated by discharging the capacitor (charger) C, flows to the light-emitting diode PHD4 of the fourth photo coupler. Then, the light-receiving transistor PHT4, which is optically coupled to the light-emitting diode PHD4, is turned on.

BY turning on the light-receiving transistor PHT4, the coil K1 of the first electromagnetic relay is excited and the constant-opened contact K1-2 for output is closed. The constant-opened contact K1-1 for control is closed and the constant-closed contact K1-3 for control is opened. By closing the constant-opened contact K1-2 for output, the interval between the output terminals OUT1 and OUT2 is energized, and the load connected to the energized interval is driven.

On the contrary, the first switch S1 or the second switch S2 is opened and, thereby, the self-maintaining state of the first electromagnetic relay or the second electromagnetic relay is canceled. The constant-opened contact K1-2 or K2-2 for output is opened and, thereby, the driving of the load is stopped.

(Abnormal Operation)

Next, a description is given of operations of the relay apparatus when a failure due to the short-circuit is caused in the third switch S3 as the external input for start.

When the first switch S1 and the second switch S2 are closed in a state in which the failure due to the short-circuit is caused in the third switch S3, the capacitor (charger) C is to be charged via the resistor R1. However, the third switch S3 is failed due to the short-circuit and, therefore, a voltage is applied to the positive side of the coil K2 of the second electromagnetic relay. Thus, the coil K2 is excited and the constant-closed contact K2-3 for control is opened. The capacitor (charger) C cannot sufficiently be charged.

The constant-opened contact K2-1 for control for self maintenance is closed by exciting the coil K2 of the second electromagnetic relay. Current flows to the light-emitting diode PHD3 of the third photo coupler and the light-emitting transistor PHT3, which is optically coupled to the light-receiving diode PHD3, is turned on. However, the capacitor (charger) C cannot sufficiently be charged, that is, the amount of charges to generate a voltage of 8.2 V or more is not charged and therefore the light-emitting diode PHD4 of the fourth photo coupler cannot emit light.

Hence, the fourth photo coupler cannot output a self-maintenance setting signal to the coil K1 of the first electromagnetic relay and the first electromagnetic relay cannot be self-maintained. The constant-opened contact K1-2 for output is not closed and the interval between the output terminals OUT1 and OUT2 is not energized and the load thereto is not driven.

Since a signal is not safely outputted if the sequence for the external inputs 1 and 2 at the two external input contact portions and the external input for start at the external input contact portion for start is reversed, the sequence for external input can be checked.

According to the second embodiment of the present invention, the first and second electromagnetic relays comprise the electromagnetic relay with the forced guiding mechanism. The self-maintenance setting signal output means (the other starting means) for outputting the self-maintenance setting signal to the first electromagnetic relay comprises an electronic circuit and, therefore, the relay apparatus can be miniaturized with the safety function and with low costs.

The load is not driven when the failure due to the short-circuit is caused in the third switch 3 as the external input for start of the other starting means. Consequently, the safety function can further be improved and the occurrence of the failure due to the short-circuit can easily and fast be detected.

Third Embodiment

A description is given of a relay apparatus according to a third embodiment of the present invention.

According to the third embodiment of the present invention, in the relay apparatus, the other starting means comprises: the capacitor (charger) C which charges electrical energy by energization and discharges the electrical energy when the second electromagnetic relay as the self-maintaining relay of the first electromagnetic relay is self-maintained; a transistor Tr for start, as switching means for start which outputs a start signal to the first electromagnetic relay as the self-maintaining relay of the second electromagnetic relay; and fifth switching means which is operated when the second electromagnetic relay is self-maintained and conducts the electrical energy charged to the capacitor (charger) C to the transistor Tr for start so as to operate the transistor Tr for start.

The fifth switching means comprises a fifth photo coupler (phototransistor coupler). The fifth photo coupler comprises a light-emitting diode PHD5 which emits light as an output when the second electromagnetic relay is self-maintained and a light-receiving transistor PHT5 which is operated by the output of the light-emitting diode PHD5 and conducts the electrical energy charged to the capacitor (charger) C, as a start signal, to the transistor Tr for start so as to operate the transistor Tr for start.

That is, the first switch S1 connected to the input terminals T11 and T12, the coil K1 of the first electromagnetic relay, the constant-opened contact K1-1 for control, and the diode D5 are serially connected among terminals of the power source E. Thus, a self-maintaining circuit of the first electromagnetic relay is formed in which the first switch S1 is a contact for reset and the constant-opened contact K1-1 for control is a contact for maintenance. The transistor Tr for start is integrated in the self-maintaining circuit, in parallel with the constant-opened contact K1-1 for control and the diode D5. The diode D2 is integrated to the collector of the transistor Tr for start.

The second switch S2 connected to the input terminals T21 and T22, the diode D3, the constant-opened contact K2-1 for control of the second electromagnetic relay, and the coil K2 of the second electromagnetic relay are serially connected among terminals of the power source E. Thus, a self-maintaining circuit of the second electromagnetic relay is formed in which the second switch S2 is a contact for reset and the constant-opened contact K2-1 for control is a contact for maintenance. The light-emitting diode PHD5 of the fifth photo coupler is integrated in this self-maintaining circuit at an anode of the diode D3.

The third switch S3 connected to the input terminals T31 and T32 is connected to the positive side of the coil K2 of the second electromagnetic relay via the diode D4 and the constant-closed contact K1-3 for control of the first electromagnetic relay.

The first switch S1, the constant-closed contact K2-3 for control of the second electromagnetic relay, the diode D1, the resistor R1, and the capacitor (charger) C are serially connected in order thereof and are inserted to a closed circuit via the power source E. The Zener diode ZD for setting the threshold, the resistor R2, the light-receiving transistor PHT5 of the fifth photo coupler, and the resistor R3 are serially connected in order thereof and are inserted to the closed circuit in parallel with the capacitor (charger) C. An emitter (output side) of the light-receiving transistor PHT5 is connected to the base of the transistor Tr for start.

Threshold setting means for setting a threshold of a drive voltage for driving the transistor Tr for start comprises the capacitor (dielectric) C, the Zener diode ZD for setting the threshold, and the resistor R2.

The constant-opened contacts K1-2 and K2-2 for output of the first and second electromagnetic relays are serially connected and are inserted between the output terminals OUT1 and OUT2. Thus, output means is formed of a closed circuit via a load (not shown).

Next, a description is given of operations of the relay apparatus having the above-mentioned structures.

(Normal Operation)

There are two patterns of normal operations. In the case of a pattern 1, there are inputs in order of the external input 2 and the external input 1. In the case of a pattern 2, there are inputs in order of the external input 1 and the external input 2.

In the case of the pattern 1, first, the second switch S2 as the external input 2 is closed. Next, when the first switch S1 as the external input 1 is closed, the capacitor (charger) C is charged and a potential of the cathode of the Zener diode ZD for setting the threshold is, e.g., 24 VDC.

When the third switch S3 as the external input for start is manually set, the coil K2 of the second electromagnetic relay is excited and the constant-opened contact K2-2 for output is closed. Then, the constant-opened contact K2-1 for control is closed and the constant-closed contact K2-3 for control is opened.

By closing the constant-opened contact K2-1 for control for self-maintenance, current flows to the light-emitting diode PHD5 which is serially connected to the constant-opened contact K2-1 for control. Then, the light-receiving transistor PHT5, which is optically coupled to the light-emitting diode PHD5, is turned on.

By turning on the light-receiving transistor PHT5, a voltage generated by discharging the capacitor (charger) C is applied to a base of the transistor Tr for start. Then, the transistor Tr for start is turned on and the coil K1 of the first electromagnetic relay is excited. The constant-opened contact K1-2 for output is closed, the constant-opened contact K1-1 for control is closed, and the constant-closed contact K1-3 for control is opened.

Incidentally, the threshold for operating the transistor Tr for start is set to be, e.g., 8.2 V. The threshold is set by the selection of the resistor R1, the Zener diode ZD for setting the threshold, and the capacitor (charger) C.

As mentioned above, the transistor Tr for start outputs a self-maintenance setting signal to the coil K1 of the first electromagnetic relay. As a consequence, the first electromagnetic relay is self-maintained and the constant-opened contact K1-2 for output is closed. Then, the interval between the output terminals OUT1 and OUT2 is energized and a load (not shown) connected to the energized interval is driven.

On the contrary, when the first switch S1 or the second switch S2 is opened, a self-maintaining state of the first electromagnetic relay or the second electromagnetic relay is canceled. By opening the constant-opened contact K1-2 or K2-2 for output, the operation for driving the load is stopped.

In the case of the pattern 2, the first switch S1 as the external input 1 is closed. The capacitor (charger) C is charged and a potential of a cathode of the Zener diode ZD for setting the threshold is 24 VDC. Next, the second switch S2 as the external input 2 is closed.

When the third switch S3 as the external input for start is manually set, the coil K2 of the second electromagnetic relay is excited and the constant-opened contact K2-2 for output is closed. The constant-opened contact K2-1 for control is closed and the constant-closed contact K2-3 for control is opened. Subsequently, the same operations as those of the pattern 1 are performed.

(Abnormal Operation)

When a failure due to the short-circuit is caused in the third switch S3 as the external input for start, there are two patterns 1 and 2 of the operation of the relay apparatus. In the case of the pattern 1, there are inputs in order of the external input 2 and the external input 1. In the case of the pattern 2, there are inputs in order of the external input 1 and the external input 2.

In the case of the pattern 1, first, the second switch S2 as the external input 2 is closed. Next, the first switch S1 as the external input 1 is closed to charge the capacitor (charger) C via the resistor R1. However, since the third switch S3 is failed due to the short-circuit, a voltage is applied to the positive side of the coil K2 of the second electromagnetic relay. Then, the coil K2 is excited and the constant-closed contact K2-3 for control is opened. In the case of a pattern 1, there are inputs in order of the external input 2 and the external input 1. Therefore, the capacitor (charger) C cannot sufficiently be charged.

The constant-opened contact K2-1 for control for self-maintenance is closed by exciting the coil K2 of the second electromagnetic relay. Current flows to the light-emitting diode PHD5, and the light-receiving transistor PHT5, which is optically coupled to the light-emitting diode PHD5, is turned on. However, the capacitor (charger) C cannot sufficiently be charged, that is, the amount of charges to generate a voltage of 8.2 V or more is not charged to the capacitor (charger) C. Therefore, the transistor Tr for start cannot be turned on.

Hence, the transistor Tr for start cannot output a self-maintenance setting signal to the coil K1 of the first electromagnetic relay and the first electromagnetic relay is not self-maintained. The constant-opened contact K1-2 for output is not closed, the interval between the output terminals OUT1 and OUT2 is not energized, and a load connected to the energized interval is not driven.

In the case of the pattern 2, the first switch S1 as the external input 1 is closed. The capacitor (charger) C is to be charged via the resistor R1 and, however, a voltage is applied to the positive side of the coil K2 of the second electromagnetic relay because the third switch S3 is failed due to the short-circuit. The coil K2 is excited, the constant-opened contact K2-2 for output and the constant-opened contact K2-1 for control are closed, and the constant-closed contact K2-3 for control is opened.

Since the second switch S2 as the external input 2 is not closed, no current flows to the light-emitting diode PHD5 if the constant-opened contact K2-1 for control of the second electromagnetic relay is closed.

Next, the second switch S2 as the external input 2 is closed and current flows to the light-emitting diode PHD5. Then, the light-receiving transistor PHT5, which is optically coupled to the light-emitting diode PHD5, is turned on. However, the capacitor (charger) C is not sufficiently charged, that is, the amount of charges to generate a voltage of 8.2 V or more is not charged and, therefore, the transistor Tr for start is not turned on.

Hence, the transistor Tr for start cannot output the self-maintenance setting signal to the coil K1 of the first electromagnetic relay and the first electromagnetic relay is not self-maintained. The constant-opened contact K1-2 for output is not closed and the interval between the output terminals OUT1 and OUT2 is not energized and a load connected to the energized interval is not driven.

According to the third embodiment of the present invention, the first and second electromagnetic relays comprise an electromagnetic relay with a forced-guiding mechanism. The self-maintenance setting signal output means for outputting the self-maintenance setting signal to the first electromagnetic relay comprises an electronic circuit and, therefore, the relay apparatus can be miniaturized with the safety function and with low costs.

When the failure due to the short-circuit is caused in the third switch S3 as the external input constant for start of the one starting means, the load is not driven. As a consequence, the safety function is further improved and the occurrence of the failure due to the short-circuit can easily and fast be detected.

As mentioned above, in the relay apparatus according to the present invention, the one self-maintaining relay and the other self-maintaining relay comprise the electromagnetic relay. The self-maintenance setting signal output means for outputting the self-maintenance setting signal to the other self-maintaining relay (the other starting means) comprises the electronic circuit. Accordingly, the relay apparatus can be miniaturized with the safety function and with low costs.

When the failure due to the short-circuit is caused in the external input for start of the one starting means, the load is not driven. Accordingly, the safety function can further be improved and the occurrence of the failure due to the short-circuit can easily and fast be detected.

What is claimed is:

1. A relay apparatus comprising:

at least one self-maintaining relay and another self-maintaining relay which are provided corresponding to input terminals;

a dielectric which charges and discharges electrical energy;

energizing means which energizes said dielectric and charges said electrical energy to said dielectric;

one starting means which outputs a start signal to an input side of the one self-maintaining relay and enables a self-maintaining circuit of the one self-maintaining relay to be formed;

another starting means which is operated by a self-maintaining operation of the one self-maintaining relay, outputs the electrical energy charged to said dielectric as a start signal, and enables a self-maintaining circuit of the other self-maintaining relay to be formed; and output means which is operated by the self-maintaining operations of the one self-maintaining relay and the other self-maintaining relay and outputs an output signal to an output terminal connected to a load, and wherein the one self-maintaining relay and the other self-maintaining relay comprise an electromagnetic relay and the other starting means comprises an electronic circuit including said dielectric.

2. A relay apparatus according to claim 1, wherein the one self-maintaining relay and the other self-maintaining relay comprise an electromagnetic relay with a forced guiding mechanism, and the other starting means comprises:

said dielectric which charges said electrical energy by energization and discharges said electrical energy when the other self-maintaining relay is self-maintained;

switching means for start, which outputs a start signal to the other self-maintaining relay;

first switching means which is operated when the one self-maintaining relay is self-maintained and outputs said electrical energy charged to said dielectric, as said start signal; and second switching means which is operated by receiving said output signal from said first switching means and conducts a power voltage to said switching means for start so as to operate said switching means for start.

3. A relay apparatus according to claim 2, wherein said switching means for start is a transistor for start, said first switching means comprises a first photo coupler, said first photo coupler comprises a light-emitting diode which emits light as an output when the one self-maintaining relay is self-maintained and a light-receiving transistor which is operated by the output of the light-emitting diode and outputs said electrical energy charged to said dielectric as said start signal, and said second switching means comprises a second photo coupler, said second photo coupler comprises a light-emitting diode which emits light as an output by receiving said output signal of said light-receiving transistor in said first photo coupler and a light-receiving transistor which is operated by the output of the light-emitting diode and conducts said power voltage to said transistor for start so as to operate said transistor for start.

4. A relay apparatus according to claim 1, wherein the one self-maintaining relay and the other self-maintaining relay comprise an electromagnetic relay with a forced guiding mechanism, the other starting means comprises:

said dielectric which charges said electrical energy by energization and discharges said electrical energy when the other self-maintaining relay is self-maintained;

third switching means which is operated when the one self-maintaining relay is self-maintained and outputs said electrical energy charged to said dielectric, as said start signal; and fourth switching means which is operated by receiving said start signal from said third switching means and conducts a power voltage to an input side of the other self-maintaining relay so as to self-maintain the other self-maintaining relay.

5. A relay apparatus according to claim 4, wherein said third switching means comprises a third photo coupler, said third photo coupler comprises a light-emitting diode which emits light as an output when the one self-maintaining relay is self-maintained and a light-receiving transistor which outputs said electrical energy charged to said dielectric as said start signal, and said fourth switching means comprises a fourth photo coupler, said fourth photo coupler comprises a light-emitting diode which emits light as an output by receiving said output signal of said light-receiving transistor in said third photo coupler and a light-receiving transistor which is operated by the output of the light-emitting diode and conducts said power voltage to an input side of the other self-maintaining relay so as to self-maintain the other self-maintaining relay.

6. A relay apparatus according to claim 1, wherein the one self-maintaining relay and the other self-maintaining relay comprise an electromagnetic relay with a forced guiding mechanism, and the other starting means comprises:

said dielectric which charges said electrical energy by energization and discharges said electrical energy when the one self-maintaining relay is self-maintained;

switching means for start, which outputs said start signal to the other self-maintaining relay; and fifth switching means which is operated when the one self-maintaining relay is self-maintained and conducts said electrical energy charged to said dielectric to said switching means for start so as to operate said switching means for start.

7. A relay apparatus according to claim 6, wherein said switching means for start is a transistor for start, said fifth switching means comprises a fifth photo coupler, said fifth photo coupler comprises a light-emitting diode which emits light as an output when the one self-maintaining relay is self-maintained and a light-receiving transistor which is operated by the output of the light-emitting diode and conducts said electrical energy charged to said dielectric, as said start signal, so as to operate said transistor for start.

8. A relay apparatus according to claim 1, wherein said energizing means is an external input contact portion which outputs a self-maintenance setting signal to the one self-maintaining relay, the one starting means is an external input contact portion for start, which outputs a self-maintenance setting signal to the one self-maintaining relay.

9. A relay apparatus according to claim 3, further comprising:

threshold setting means which sets a threshold of a drive voltage for driving said transistor for start.

10. A relay apparatus according to claim 5, further comprising:

threshold setting means which sets a threshold of a drive voltage for driving said light-receiving transistor in said fourth photo coupler.

11. A relay apparatus according to claim 9, wherein said threshold setting means comprises:

said dielectric which varies a charge voltage by changing a capacitance;

a resistor which limits charges in said dielectric; and a Zener diode for setting a threshold, which outputs said drive voltage when the charge voltage of said dielectric is higher than a set voltage.

* * * * *